United States Patent [19]

Deve

[11] Patent Number: 4,565,328

[45] Date of Patent: Jan. 21, 1986

[54] SAND RECLAMATION SYSTEM WITH THERMAL PIPE RECLAIMER APPARATUS

[75] Inventor: Vagn Deve, East Washington, Pa.

[73] Assignee: Combustion Engineering, Inc., Windsor, Conn.

[21] Appl. No.: 521,495

[22] Filed: Aug. 8, 1983

[51] Int. Cl.[4] ..... B02C 19/12

[52] U.S. Cl. ..... 241/65; 241/DIG. 10

[58] Field of Search ..... 241/DIG. 10, 5, 101.2, 241/39, 65, 66, 67, 70, 71, 72, 80, 97, 40, 101 B, 79.3, 152 A; 164/5, 412

[56] References Cited

U.S. PATENT DOCUMENTS

| | | | |
|---|---|---|---|
| 2,861,353 | 11/1958 | Lellep | 241/65 X |
| 3,837,583 | 9/1974 | Kugelberg et al. | 241/5 X |
| 3,840,188 | 10/1974 | Coombe et al. | 241/5 X |

*Primary Examiner*—Mark Rosenbaum

*Attorney, Agent, or Firm*—Arthur E. Fournier, Jr.

[57] ABSTRACT

A system (10) particularly suited for treating solid, granular and aggregate material by means of thermal reclamation. The subject (10) includes, arranged in co-operatively associated series relation, storage hopper means (12), heat exchanger means (14), thermal pipe reclaimer means (16) and cyclone scrubber means (18). The function of the storage hopper means (12) is to store therewithin a suitable supply of grain size material, which is to be treated. At a preestablished rate the material is fed from the storage hopper means (12) to the heat exchanger means (14). While traveling through the heat exchanger means (14) the material is preheated to a first temperature. From the heat exchanger means (14) after undergoing metal separation and crushing of lumps, the material is supplied to the thermal pipe reclaimer means (16) wherein the material is heated to a specified temperature for a predetermined period of time in order to effect the burning away of organic matter which the material embodies. After leaving the thermal pipe reclaimer means (16) the material travels to the cyclone/scrubber means (18) wherein the surface of the grain size material is cleansed and post reclamation of the material occurs. The material, which is now at a second temperature, is then again conveyed to the heat exchanger means (14) whereupon during the course of traveling therethrough the material is cooled to a suitable temperature.

12 Claims, 3 Drawing Figures

SAND RECLAMATION SYSTEM WITH THERMAL PIPE RECLAIMER APPARATUS

CROSS-REFERENCE TO RELATED APPLICATIONS

This application is hereby cross-referenced to the following two patent applications which were commonly filed herewith and which are assigned: U.S. patent application Ser. No. 521,494, filed Aug. 8, 1983, entitled "Apparatus With Heat Exchange Means And Transfer Pipe For Treating Solid, Granular And Aggregate Materials", filed in the name of Vagn Deve; and U.S. patent application Ser. No. 521,498, filed Aug. 8, 1983, entitled "Apparatus With Heat Exchange Means For Treating Solid, Granular And Aggregate Material", filed in the name of Vagn Deve.

BACKGROUND OF THE INVENTION

This invention relates to systems of the type that are intended to treat solid, granular and aggregate material, and, more particularly, to a system embodying thermal pipe reclaimer apparatus for effecting the treatment by thermal reclamation of material, e.g., reclaiming spent chemically bonded foundry sand and clay bonded foundry sand.

As evidenced by a reference to the prior art, there have been attempts made previously in an effort to treat material by thermal reclamation. In this regard, the focus of one of these prior art attempts has been on an effort to effect the reclamation of foundry sand. One rationale behind this effort has been that if it were to prove possible to effect a recycling of the foundry sand, this would go far towards forestalling the exhaustion of existing sources of supply of foundry sand. Furthermore, to the extent that recycling of the foundry sand takes place at or in relatively close proximity to the individual foundry sites whereat the use was originally made of the foundry sand, the effect thereof would be to negate substantially, if not totally, the need to incur the expenses associated with the transportation of foundry sand from the sources of supply thereof to the foundry sites. In addition, the ability to reclaim used foundry sand obviates the problem associated with the need to find a suitable disposal site for the used foundry sand.

Insofar as the reclamation of used foundry sand is concerned, there are at least two major requirements, which from a practical standpoint, must be satisfied thereby. Namely, the used foundry sand after being subjected to the reclamation process must be in substantially the same condition as it originally was. That is, the reclamation process must be capable of returning the used foundry sand, in essence, to its original condition. Secondly, the reclamation of used foundry sand must be capable of being accomplished economically. More specifically, the cost of reclamation must be such that reclamation from a financial standpoint is sufficiently attractive to render it desirable to undertake the investment in terms of time, labor and money required thereby as compared to continuing to purchase new, i.e., not previously used, foundry sand.

With respect to this matter of the reclamation of used foundry sand, a variety of different types of apparatus have been proposed for use. These apparatus may, for ease of reference, be classified into categories according to the type of treatment to which the used foundry sand is subjected for purposes of effecting the reclamation thereof. Thus, one category of such apparatus is that of mechanical units. Here, reliance is had, generally speaking, on some form of abrasive action in order to effect the removal of, for example, organic coatings from the particles of sand. This abrasive action may be realized through the action of some sort of mechanical member, or through the use of a so-called "air scrubber". The latter refers to a type of device wherein the sand particles are accelerated to relatively high velocities by means of compressed air such that a rubbing action is caused to occur between individual particles of sand. In other instances, the sand particles after being accelerated are made to impinge against a suitably selected surface such that as a result of this impingement the coating fractures and separates from the individual sand particle. For purposes of illustration of a mechanical unit which has been proposed in the prior art for use in connection with the reclamation of foundry sand, reference may be had to U.S. Pat. No. 4,283,015, that issued on Aug. 11, 1981. This patent depicts an apparatus which is intended to be employed for purposes of removing no-bake coatings from foundry sand.

A second category into which such apparatus may be placed, and the one into which the system of the present invention falls, is that of thermal units. In accord therewith, heat is employed for purposes of accomplishing the removal of organic coatings from the sand particles. By way of exemplification in this regard, there has previously been issued on Aug. 22, 1972 to the applicant of the present invention, U.S. Pat. No. 3,685,165. The latter patent is directed in particular to an apparatus for thermally reclaiming resin coated sand. More recently, U.S. patent application Ser. No. 369,334 was filed on Apr. 16, 1982 in the name of the applicant of the present invention directed to another form of thermal reclaimer apparatus. In accord with the teachings of this latter patent application, which issued on Feb. 7, 1984 as U.S. Pat. No. 4,429,642, there is provided an apparatus embodying rotatable chamber means in which the foundry sand that is to be reclaimed is heated to a predetermined temperature for a preestablished period in order to accomplish the burning away of the organic matter that the used foundry sand contains.

It is deemed important to make mention here of the fact that the impression should not be had that in order for one to provide a system for effecting the reclamation of used foundry sand, there is a need to be concerned only with the matter of removing organic coatings from sand particles. For, depending upon the condition of the foundry sand that it is desired to reclaim, which in turn is a function of the manner in which the foundry sand has been used, a number of other considerations may be of equal, if not greater, importance. For example, significant amounts of used foundry sand are produced during foundry operations wherein the used foundry sand is replete with organic matter, metal, dust and fines.

As regards the matter of the thermal reclamation of used foundry sand, and in particular that kind of foundry sand which has organic matter, metal, dust and fines present therein, there are a number of factors to which it is desirable that consideration be given if a thermal foundry sand reclamation system is to be provided that will prove to be viable from a commercial standpoint. More specifically, such a thermal foundry sand reclamation system must be capable of accomplishing the removal of the organic matter from the used foundry sand while at the same time leaving the metal that is also present in the used foundry sand in such a form as to enable it subsequently to be readily removed. Thus, one of the factors that must be taken into account in this regard is that of being able to provide sufficient heat to the used foundry sand so that the organic matter present therein is burned away. However, the operating characteristics of the thermal system must be such that the used foundry sand is not heated excessively, i.e., to such a high temperature that the heat produced is sufficient to effect a change in the state of the metal which is present in the used foundry sand. To this end, such a thermal system for reclaiming used foundry sand must possess the capability of enabling the organic matter to be burned away, while at the same time this is being accomplished ensuring that the metal, be it of a ferrous or non-ferrous nature, which the used foundry sand contains, is not adversely affected, i.e., rendered more difficult to remove, as a consequence of being exposed to the heat that is employed to burn away the organic matter. In this regard, note is taken here of the fact that some nonferrous metals, e.g., aluminum and zinc, have a significantly different melting temperature than do ferrous metals, and consequently must be treated differently from a temperature standpoint.

Another factor which must be borne in mind when one attempts to provide such a thermal system for reclaiming used foundry sand which contains organic matter, metal, dust and fines is that of the nature of the treatment which should be accorded to the fumes that are generated as the organic matter is being burned away. There are two aspects to this. The first is that of ensuring that such fumes do not pose a danger to the personnel who are attending to the operation of the thermal foundry sand reclamation system. The second is that of ensuring that any fumes which may be exhausted to the atmosphere do not constitute a source of pollutants. That is, the fumes which are exhausted to the atmosphere as a consequence of the operation of such a thermal system for reclaiming used foundry sand should not violate the regulations applicable thereto as established by the cognizant local, state and federal authorities. The third factor to which it is essential that consideration be given in providing such a thermal foundry sand reclamation system is the matter of the cost thereof. Namely, both in terms of originally providing the system and in terms of operating the system thereafter, the expenditures required thereby must be such as to render it desirable to undertake the requisite investment as compared to continuing the expenditure of the funds necessary to acquire new, i.e., virgin, foundry sand rather than reclaimed foundry sand.

Related to this matter of cost, which is addressed in the preceding paragraph, is the matter of the production output of reclaimed foundry sand that can be realized through the use of such a thermal foundry sand reclamation system. Reference is had here to the fact that for such a thermal foundry sand reclamation system to be commercially viable, it is necessary that the system embody the capability of providing reclaimed foundry sand in the desired quantities, i.e., in amounts sufficient to meet the need therefor as it exists at any given site at which foundry operations capable of making use thereof take place.

In summary, the salient point which the preceding discussion serves to make is the fact that there already has been shown to exist in the prior art a need for a system which is operative to effect the reclamation of used foundry sand. And in particular the previous discussion evidences a need in the prior art for a system that is operative to reclaim used foundry sand which contains metal of either a ferrous or nonferrous nature, organic matter, dust and fines. Further, one of the major component parts that any such system for reclaiming used foundry sand includes is a thermal reclaimer apparatus. The latter apparatus is operative for thermally removing from the used foundry sand the organic matter that the latter contains.

As a consequence of providing such a new and improved system for reclaiming used foundry sand there has also been shown to exist a need in the prior art for a new and improved form of thermal reclaimer apparatus that would be suitable for employment for purposes of effecting the thermal removal of organic matter from used foundry sand. That is, there has been sought to be provided a thermal reclaimer apparatus which is characterized by the fact that it is capable of being cooperatively associated in operative relation with the other components which together comprise the system for the reclamation of used foundry sand. Some of the other characteristics which it would be desirable for such a new and improved thermal reclaimer apparatus to embody include the following: be inexpensive to manufacture, be capable of being installed easily and at low cost, require little attention during the operation thereof, require little maintenance and be highly efficient from the standpoint of the amount of energy required thereby for the purpose of the operation thereof.

It is, therefore, an object of the present invention to provide a system for treating solid, granular and aggregate material which embodies therein reclaimer means for effecting the thermal removal of matter from the material.

It is another object of the present invention to provide a new and improved thermal reclaimer apparatus which is capable of being cooperatively associated in operative relation with the other components that together therewith comprise the system for treating solid, granular and aggregate material.

It is still another object of the present invention to provide such a thermal reclaimer apparatus for such a system for treating solid, granular and aggregate material that is characterized in that it is relatively inexpensive to manufacture.

A further object of the present invention is to provide such a thermal reclaimer apparatus for such a system for treating solid, granular and aggregate material that is characterized in that it is capable of being easily installed and at low cost.

A still further object of the present invention is to provide such a thermal reclaimer apparatus for such a system for treating solid, granular and aggregate material that is characterized in that it necessitates little attention being given thereto during the operation thereof.

Yet a further object of the present invention is to provide such a thermal reclaimer apparatus for such a system for treating solid, granular and aggregate material that is characterized in that it requires little maintenance.

Yet another object of the present invention is to provide such a thermal reclaimer apparatus for such a system for treating solid, granular and aggregate material that is characterized in that it is highly efficient from the standpoint of the amount of energy required to be used thereby for purposes of the operation thereof.

SUMMARY OF THE INVENTION

In accordance with the present invention there is provided a new and improved system for effecting the treatment of solid, granular and aggregate material by thermal means. The subject system is particularly suited for use for thermally reclaiming used foundry sand of the kind that contains organic matter, metal, dust and fines. Arranged in series relation so as to be cooperatively associated one with another the subject system encompasses the following components: a storage hopper means, heat exchanger means, thermal pipe reclaimer means and a cyclone/scrubber means. There is stored within the storage hopper means grain size used foundry sand, lumps and metal, which is to be thermally reclaimed. Preferably, the storage hopper means embodies metering means operative for purposes of effecting the discharge of used foundry sand, lumps and metal from the storage hopper means at a predetermined rate. A supply pipe means connects the storage hopper means in fluid flow relation to the heat exchanger means such that the used foundry sand after leaving the storage hopper means flows through the supply pipe means to the heat exchanger means. While traveling in a first direction through the heat exchanger means the used foundry sand is preheated from a first temperature to a second temperature. Further, while in the heat exchanger means the used foundry sand is subjected to a crushing action and a sifting action. The effect of the crushing action is to cause the disintegration of any friable sand lumps that may be present in the used foundry sand, while the sifting action is effective to separate oversized particles of material and metal that may be present in the used foundry sand from those particles therein that are of an acceptable size. From the heat exchanger means the preheated used foundry sand is suitably conveyed to a new and improved form of thermal reclaimer means. The latter thermal reclaimer means consists of a pipe reclaimer apparatus that has cooperatively associated therewith an air blower and a burner. The air blower and burner are operative to generate a sufficient amount of high temperature gas to effect the transport of the used foundry sand through the pipe reclaimer apparatus at a predetermined velocity. In the course of being conveyed through the pipe reclaimer apparatus organic matter contained in the used foundry sand is burned away. From the pipe reclaimer apparatus the used foundry sand, which is now at a third temperature, is fed to the cyclone/scrubber means wherein the grain size sand particles are scrubbed and post reclamation of the used foundry sand takes place. The used foundry sand then is made to flow to the heat exchanger means wherein during the course of a passage therethrough in a second direction the used foundry sand undergoes cooling. Upon being discharged from the heat exchanger means the used foundry sand leaves the system after having been thermally reclaimed therein.

DESCRIPTION OF A PREFERRED EMBODIMENT

Figure 1:
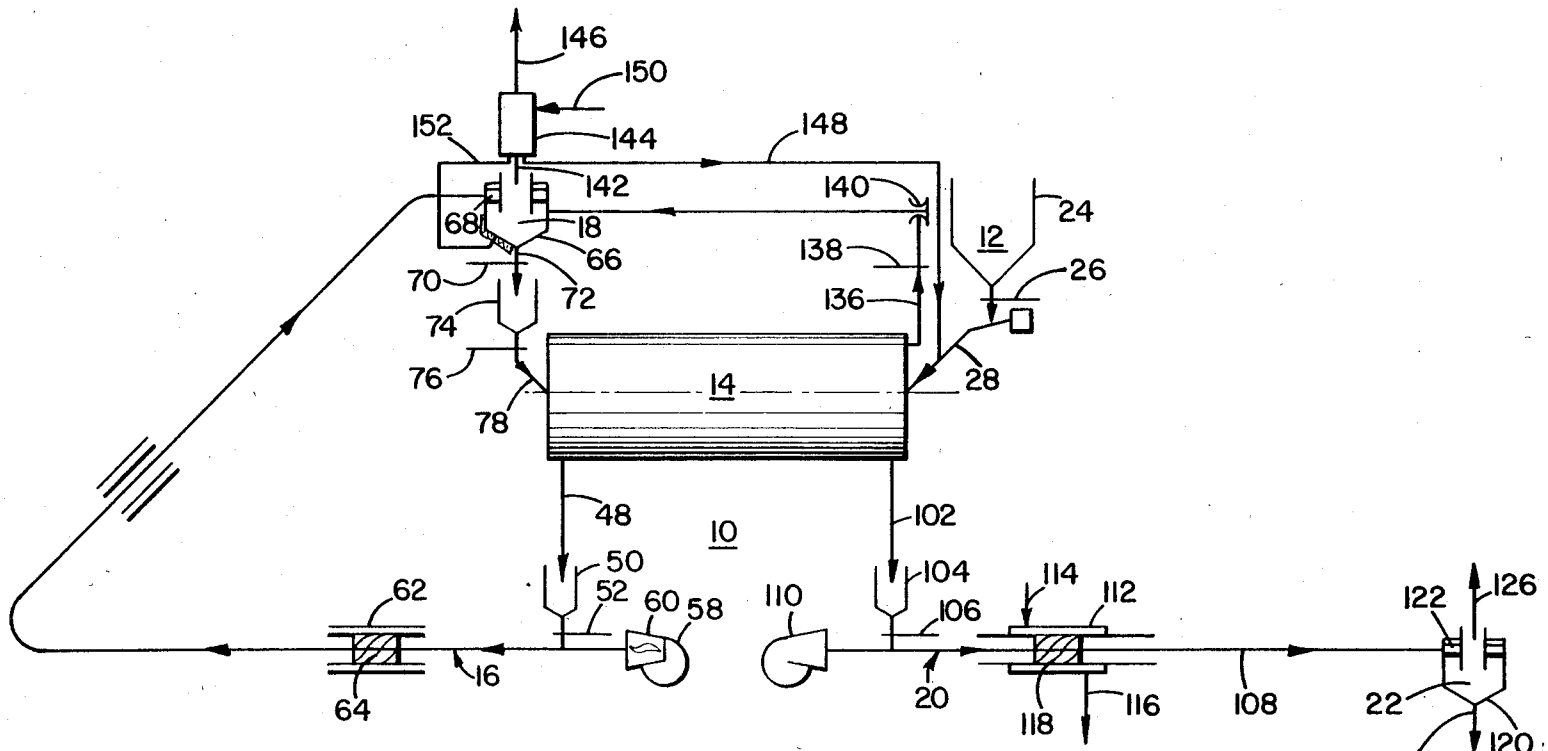
FIG. 1 is a schematic diagram of a system for effecting the treatment of solid, granular and aggregate material by thermal means, constructed in accordance with the present invention.

Referring now to the drawing, and more particularly to FIG. 1 thereof there is depicted therein a system for effecting the treatment by thermal means of solid, granular and aggregate materials, generally designated by reference numeral 10, constructed in accordance with the present invention. The system 10 is primarily designed to be utilized for purposes of effecting the thermal reclamation of used foundry sand, and in particular used foundry sand of the kind which contains organic matter, metal of either a ferrous or nonferrous nature, dust and fines. As best understood with reference to FIG. 1, the system 10 includes a multiplicity of components that are suitably arranged so as to be cooperatively associated in series relation one with another. More specifically, in accord with the illustration thereof in FIG. 1, the major components of the system 10 comprise the following: storage hopper means, generally designated by reference numeral 12; heat exchanger means, generally designated by reference numeral 14; thermal pipe reclaimer means, generally designated by reference numeral 16; first cyclone/scrubber means, generally designated by reference numeral 18; cooling pipe means, generally designated by reference numeral 20; and second cyclone/scrubber means, generally designated by reference numeral 22.

Continuing with the description of the system 10, the storage hopper means 12, preferably and in accord with the illustration thereof in the drawing, encompasses both a storage hopper 24 and metering means, the latter being schematically depicted in FIG. 1 at 26. The storage hopper 24, which may take the form of any hopper of conventional construction suitable for use for this purpose, is appropriately supplied with material that is designed to be thermally treated in the system 10. For purposes of the description that follows this material will be assumed to be spent, i.e., used, chemically bonded foundry sand, lumps, metal and fines. Moreover, the particles of used foundry sand, which are stored in the storage hopper 24, desirably have a dimension of minus three-quarter inch and are normally at ambient temperature. Although for purposes of the description that follows the subject matter is deemed to be used foundry sand, it is to be understood that the system 10 could equally well be employed for purposes of effecting the treatment by thermal means of other types of solid, granular and aggregate material. Suitably associated with the bottom of the storage hopper 24 is the metering means 26, which preferably comprises a metering gate of conventional design. The metering gate 26 in accord with the best mode embodiment of the invention is made to operate through the use of any suitable form of means (not shown) such that the used foundry sand is fed from the storage hopper 24 at a controlled rate.

From the storage hopper 24 the used foundry sand, as schematically depicted at 28 in FIG. 1, is conveyed by any suitable form of conveying means of a conventional nature to the heat exchanger means 14. As will be described more fully hereinafter, the function of the heat exchanger means 14 is to effect a preheating of the used foundry sand as the latter travels therethrough. Namely, the intent is that the used foundry sand be preheated from essentially ambient temperature, which is the temperature of the used foundry sand stored in the storage hopper 24 to a temperature approximating 750° F. when the used foundry sand leaves the heat exchanger means 14. One form of heat exchanger means which is suitable for use in the system 10 of FIG. 1 constructed in accordance with the present invention is that which forms the subject matter of U.S. patent application Ser. No. 521,498 entitled "Apparatus With Heat Exchanger Means For Treating Solid, Granular And Aggregate Material", which has been filed concurrently herewith in the name of the same inventor as the present application and which is assigned to the same assignee as the present application.

Figure 2:
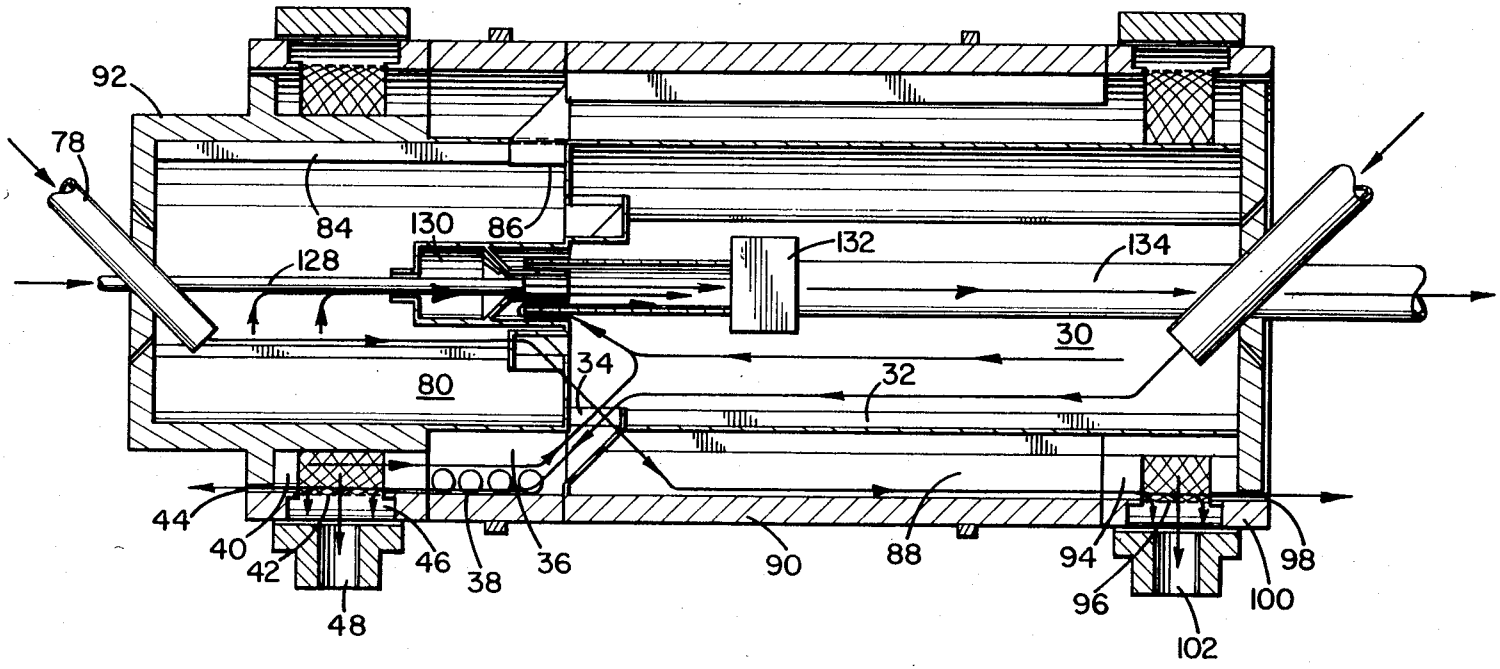
FIG. 2 is a side elevational view, in section, of a heat exchanger apparatus that is suitable for use in the system of FIG. 1 constructed in accordance with the present invention.

A brief description will now be had of the heat exchanger means 14 constructed as illustrated in FIG. 2 of the drawing. This brief description of the heat exchanger means 14 is deemed to be sufficient for one to obtain an understanding of the inventive subject matter embodied by the system 10 to which the present patent application is directed. For a more detailed description, however, of the heat exchanger means 14, reference may be had to copending U.S patent application Ser. No. 521,498.

Thus, with reference to FIG. 2 of the drawing, the heat exchanger means 14 comprises an apparatus having a substantially cylindrically shaped chamber 30 formed therewithin. The used foundry sand from the storage hopper 24 enters the chamber 30 from the conveying means 28. The chamber 30 is provided with a plurality of paddle-like members 32 that are operative to effect a mixing of the used foundry sand as the latter traverses the chamber 30 from the right end to the left end thereof as viewed with reference to FIG. 2 of the drawing. The chamber 30 is suitably mounted for rotation in a conventional manner in bearing means. To this end, the heat exchanger apparatus 14 may have cooperatively associated therewith any suitable conventional form of rotating means (not shown). The latter rotating means (not shown) is operative for purposes of effecting the rotation of the chamber 30 such that the used foundry sand that enters the latter by means of the conveying means 28 is made to travel from one end to the other of chamber 30.

After traversing the chamber 30, the used foundry sand exits therefrom through a transfer chute means, the latter being denoted generally by the reference numeral 34 in FIG. 2. That is, the used foundry sand passes from the chamber 30 through the transfer chute means 34 to a crushing means 36. The latter crushing means 36 comprises a suitably dimensioned cylindrical chamber in which a multiplicity of suitably constructed balls 38 are located each of which is of sufficient weight such as to be operative for purposes of crushing any friable foundry sand lumps that may be present in the used foundry sand when the latter enters the crushing chamber 36 through the transfer chute means 34. In this regard, note is taken here of the fact that because of the increased temperature of the used foundry sand any lumps that may be present therein lose some of their tensile strength. Further, the crushing chamber 36 is subject to the same rotational movement as the chamber 30 to which reference has previously been had hereinbefore. Thus, the rotary action to which the crushing chamber 36 is being subjected concomitant with the movement therewithin of the crushing balls 38 along with the fact that the increased temperature of the used foundry sand lowers the tensile strength of the lumps that may be present in the latter sand all jointly coact for purposes of effecting the crushing of the friable foundry sand lumps in the used foundry sand.

After being subjected to the aforedescribed crushing action, the used foundry sand leaves the crushing chamber 36 and enters the sifting chamber 40. The latter chamber 40 is substantially cylindrical in configuration and is provided on its outer surface with a suitably dimensioned opening. Positioned in juxtaposed relation to this opening is a suitably dimensioned screen 42. In addition, the sifting chamber 40 has a slot 44 provided in one of the end walls thereof for a purpose now to be described. To this end, the used foundry sand which is in the sifting chamber 40 undergoes a sifting action therein. That is, as the sifting chamber 40 rotates in the same manner as the previously described crushing chamber 36 and chamber 30, the used foundry sand is sifted such that the sand particles which are of the desired size pass through the screen 42 and enter the collecting chamber 46 which is located, as viewed with reference to FIG. 2 of the drawing, below the screen 42. On the other hand, any oversize material that may be present in the used foundry sand such as bits of metal, ceramic, etc. are discharged from the sifting chamber 40 through the slot 44 whereupon the oversize material is collected in any suitable container-like means (not shown).

Continuing, the sand particles that pass through the screen 42 enter the collecting chamber 46 and are discharged from the latter into a collecting chute, the latter being denoted by the reference numeral 48 in FIG. 2. As best understood with reference to FIG. 1 of the drawing, the collecting chute 46 is designed to be operatively connected to the thermal pipe reclaimer means 16 such that sand particles leaving the collecting chamber 46 of the heat exchanger apparatus 14 are conveyed through the collecting chute 48 to the thermal pipe reclaimer means 16 wherein the sand particles, in a manner yet to be described, are subjected to thermal reclamation. More specifically, in accord with the illustration of FIG. 1, the collecting chute 48 is operatively connected to a surge hopper, the latter being depicted schematically at 50 in FIG. 1 of the drawing. Upon leaving the heat exchanger apparatus 14, the sand particles are temporarily stored in the surge hopper 50 while awaiting to be fed to the thermal pipe reclaimer means 16. Preferably, the surge hopper 50 is equipped with a metering gate, the latter being schematically depicted at 52 in FIG. 1. The metering gate 52, which can take the form of any suitable conventional form of metering means, is designed to be operative to effect the discharge of sand particles from the surge hopper 50 to the thermal pipe reclaimer means 16 such that sand particles are fed at a predetermined rate to the thermal pipe reclaimer means 16.

Figure 3:
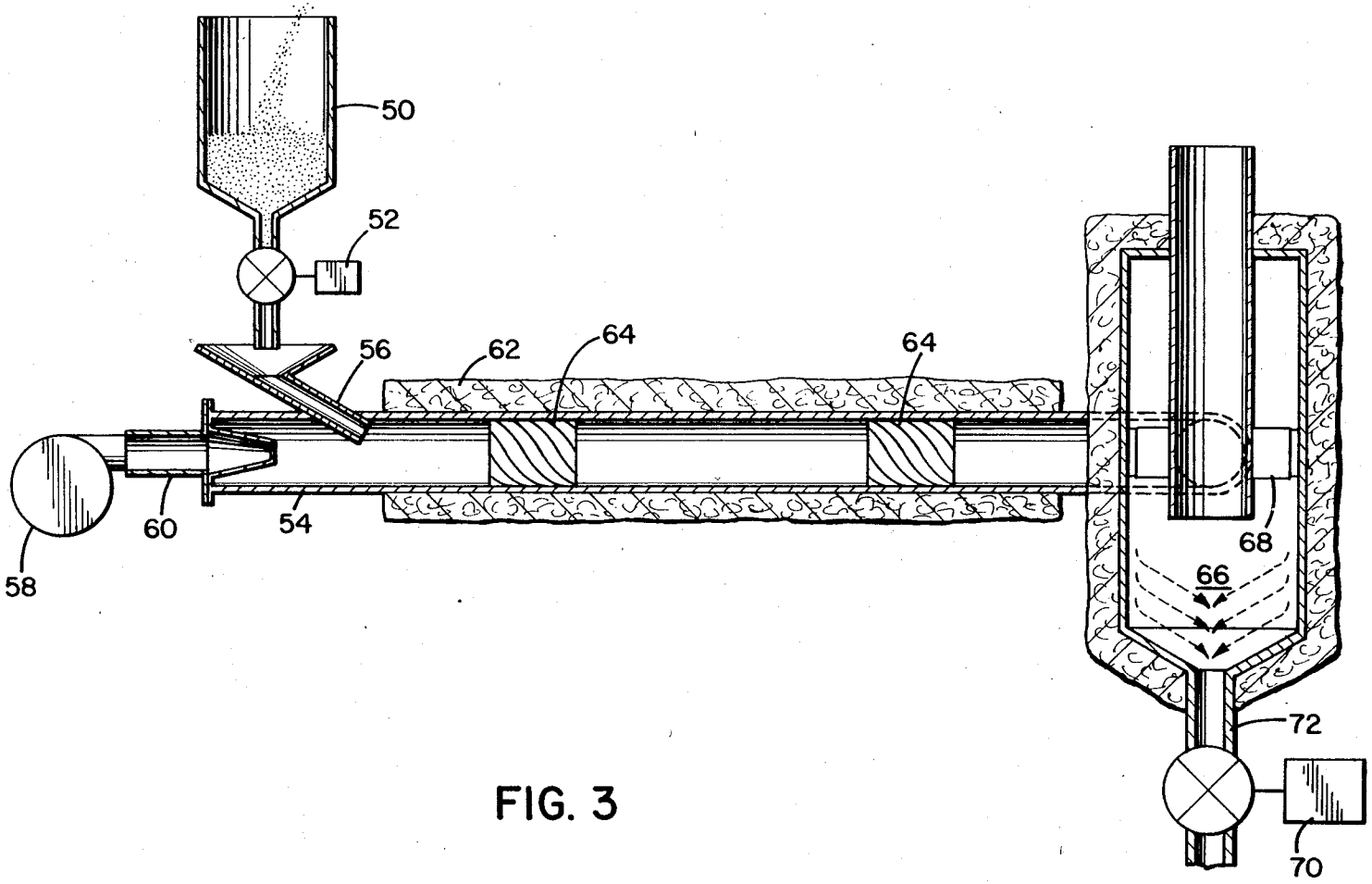
FIG. 3 is a side elevational view, partially in section, of a thermal pipe reclaimer apparatus depicted cooperatively associated with a cyclone/scrubber apparatus that is suitable for use in the system of FIG. 1 constructed in accordance with the present invention.

A description will now be had of the thermal pipe reclaimer means 16. For this purpose, reference will be made particularly to FIGS. 1 and 3 of the drawing. However, before proceeding with this description, it is deemed important that mention be made here of the fact that the thermal pipe reclaimer means 16, constructed as shown in FIGS. 1 and 3 of the drawing, is considered to comprise a new and improved form of thermal reclaimer apparatus. As can thus be seen with reference to FIGS. 1 and 3, the thermal pipe reclaimer means 16 includes a thermal pipe 54. Further, insofar as the dimensions of the thermal pipe 54 are concerned, the diameter thereof is established primarily as a function of the quantity of used foundry sand that it is desired to thermally reclaim therewithin. Similarly, the length of the thermal pipe 54 is determined primarily as a function of the amount of retention time within the thermal pipe 54 that the used foundry sand is required to have in order to accomplish the burning away of the organic matter that is contained in the used foundry sand during the course of the latter's travel through the thermal pipe 54. Without departing from the essence of the invention, the thermal pipe 54 may be made in the form of a straight length, as exemplified by the showing of the thermal pipe 54 in FIG. 3, or in the form of a member embodying a bend intermediate the ends thereof as exemplified by the showing of the thermal pipe 54 in FIG. 1.

As best understood with reference to the drawing, the thermal pipe 54 suitably incorporates means, identified in FIG. 3 by reference numeral 56, for supplying hot air to the interior of the thermal pipe 54. The means 56 may take any suitable form. However, in accord with the illustrative embodiment thereof, the means at 56 comprises a pipe-like member having one end thereof suitably connected in fluid flow relation with the interior of the thermal pipe 54 and the other end thereof suitably connected to a supply (not shown) of hot air. Continuing, the thermal pipe 54 has one end thereof connected, at a point upstream of the means 56, to an air blower 58 and a burner 60.

Insofar as the air blower 58 and burner 60 are concerned, any type of air blower and burner, respectively, of conventional construction and appropriate for use in the manner set forth hereinafter may be so employed. The air blower 58 and burner 60 are operative for purposes of generating a sufficient amount of high temperature gas, i.e., gas at a temperature of 1500° F. to 2600° F., to effect the transport through the thermal pipe 54 of the grain sized used foundry sand particles at a velocity of ten to sixty feet per second. The temperature of the gas is selected so as to be such that the temperature to which the used foundry sand is heated thereby is sufficiently high to effect the burning away of the organic matter contained in the used foundry sand. Likewise, the velocity at which the sand particles travel through the thermal pipe 54 is selected so as to be such that the sand particles will be carried along with the gas as the latter flows through the thermal pipe 54. That is, the velocity of the sand particles must be such as to cause the sand particles to travel to the end of the thermal pipe 54 and not drop out of the gas stream intermediate the ends of the thermal pipe 54, whereupon a buildup of sand particles could occur in the thermal pipe 54 which would impede the thermal reclamation operation that is designed to take place within the thermal pipe 54.

In order to accommodate the high temperatures which the thermal pipe 54 is required to withstand, the thermal pipe 54 is made of a suitable heat resistant alloy or a suitable ceramic material. Moreover, the thermal pipe 54 along its length is covered with a suitable insulative material, identified by the reference numeral 62 in FIGS. 1 and 3, in order to prevent heat loss.

Also, in accord with the best mode embodiment of the invention, the thermal pipe 54 is preferably provided at spaced intervals along the length thereof with a spinner means 64. The latter spinner means 64 each embody a substantially spiral interior surface which is operative to impart a spiral, i.e., spinning action, to the sand particles as they travel through each of spinner means 64. The effect of imparting this spinning action at periodic intervals to the sand particles is to assist in ensuring that the sand particles maintain their requisite velocity as they travel the length of the thermal pipe 54. A suitable spacing between spinner means 64 has been found to be approximately ten feet. That is, the thermal pipe 54 preferably incorporates a spinner means 64 at each ten foot interval along the length thereof. In this regard, as noted herein previously the length of the thermal pipe 54 is a function of the time that the sand particles must be retained in the thermal pipe 54 in order to effect the thermal reclamation desired thereof.

After traveling the length of the thermal pipe 54, the used foundry sand from which organic matter has been burned away while therein is discharged from the thermal pipe 54 and enters the cyclone/scrubber means 18. The latter cyclone/scrubber means 18 is suitably provided with an opening (not shown) through which the used foundry sand enters. Moreover, as best understood with reference to FIGS. 1 and 3 of the drawing the cyclone/scrubber means 18 comprises a cyclone unit 66 which embodies a ceramic scrubber sleeve 68 and further is equipped with a timed metering gate 70. The ceramic scrubber sleeve 68 which preferably possesses a slightly roughened surface is suitably located within the cyclone unit 66 so as to be in the path of movement of the sand particles after the latter enter the cyclone unit 66. The function of the scrubber sleeve 68 is to effect a cleansing of the sand particles through the engagement thereof with the slightly roughened surface of the scrubber sleeve 68. After engaging the scrubber sleeve 68, the sand particles move in a circular path within the cyclone unit 66 until eventually they make their way to the bottom of the latter. The bottom of the cyclone unit 66 is suitably sloped so as to cause a buildup of sand particles to occur thereon. The effect of permitting this buildup of sand particles to take place on the bottom of the cyclone unit 66 is to enable the sand particles to undergo post reclamation within the cyclone unit 66. Namely, the effect thereof is to in essence provide a further period, i.e., more retention time, during which the sand particles are still at a very high temperature such that a burning away of any organic matter that may remain continues. To this end, the cyclone unit 66 is provided with a layer of suitable insulative material so as to minimize the heat loss therefrom. To summarize, the bottom of cyclone unit 66 possesses a slope which approximates that of the angle of repose of the material, e.g., used foundry sand, that is being subjected to thermal treatment in the system 10 of the present invention. The used foundry sand travels to the bottom of the cyclone unit 66 along the outward wall thereof because of the rotational movement of the material within the cyclone unit 66 and gradually travels toward the area of the center discharge pipe which is identified in the drawing by reference numeral 72.

The used foundry sand is discharged from the cyclone unit 66 through the discharge pipe 72 at a predetermined rate. This rate is controlled as a consequence of the operation of the metering gate 70. As best understood with reference to FIG. 1 of the drawing, the discharge pipe 72 is operatively connected in fluid flow relation preferably to a surge hopper 74 to which the used foundry sand is made to flow upon leaving the cyclone unit 66. The surge hopper 74 also preferably has cooperatively associated therewith a metering gate, schematically depicted at 76 in FIG. 1, which is operative to control the rate of discharge of used foundry sand from the surge hopper 74. By interposing the surge hopper 74 in the system 10 between the cyclone/scrubber means 18 and the heat exchanger means 14, it is possible to accommodate the existence of different rates of retention of the used foundry sand in the cyclone/-scrubber means 18 while yet enabling the used foundry sand to be fed at a steady rate to the heat exchanger means 14. Namely, for purposes of providing the retention time in the cyclone unit 66 to enable post reclamation of the used foundry sand to be effected therein, it may be desirable to have the used foundry sand discharged therefrom at timed intervals. On the other hand, for purposes of the efficient operation of the heat exchanger means 14, it may be desirable that the used foundry sand be supplied thereto at a steady rate. The surge hopper 74 in which a buildup of used foundry sand can take place, if required, provides a means whereby such differences in the feed of the used foundry sand can be accommodated. That is, the surge hopper 74 by its existence aids in effecting a stabilization of the flow of the used foundry sand, at least in that portion of the system 10, which encompasses the heat exchanger means 14.

From the surge hopper 74, the used foundry sand, which it should be noted is at a temperature approximating 1400° F., is conveyed by means of any suitable conventional form of transport means to the heat exchanger means 14 whereupon the used foundry sand is made to enter the latter. In accord with the illustration of FIGS. 1 and 2 of the drawing, the used foundry sand after leaving the cyclone/scrubber means 18 is fed to the heat exchanger means 14 by means of the feed pipe identified in FIGS. 1 and 2 by the reference numeral 78. Mention is also made here of the fact that in addition to being at a temperature approximating 1400° F. the used foundry sand which enters the heat exchanger means 14 is of grain size.

Continuing, after entering the heat exchanger means 14, the used foundry sand is discharged from feed pipe 78 into a chamber, the latter being denoted in FIG. 2 by reference numeral 80. The chamber 80 is substantially cyclindrical in configuration, and is suitably mounted by conventional means so as to be rotatable. Referring again to FIG. 2, it can be seen therefrom that the chamber 80 is well insulated. Namely, suitable insulation, denoted in FIG. 2 generally by the reference numeral 82, is suitably provided in surrounding relation to the wall surfaces which serve to define the periphery of the chamber 80. In addition, in accord with the embodiment as illustrated, the chamber 80 is preferably suitably provided with mixing means, identified in FIG. 2 by the reference numeral 84. The mixing means 84 is operative to effect a mixing as well as an aeration of the used foundry sand while the latter is in the chamber 80.

Reclamation of the used foundry sand continues while the latter is in the chamber 80. Namely, any organic matter remaining in the used foundry sand is burned away due to the fact that the used foundry sand is at an elevated temperature of 1400° F., and oxygen is present in the atmosphere of the chamber 80. As the chamber 80 rotates the used foundry sand that enters the former by means of the feed pipe 78 traverses the chamber 80 whereupon the used foundry sand exits therefrom through transfer chute means, generally denoted by reference numeral 86 in FIG. 2. The transfer chute means 86 serves to interconnect the chamber 80 with the chamber, denoted generally in FIG. 2 by reference numeral 88. The chamber 88 is located in concentric relation to chamber 30 of the heat exchanger means 14 to which reference has been made hereinbefore. Thus, like the chamber 30 the chamber 88 is substantially cylindrical in configuration and is rotatable.

As best understood with reference to FIG. 2, the chamber 88 is suitably insulated. To this end, insulation, denoted by the reference numeral 90, is suitably positioned in surrounding relation to the wall surfaces that define the periphery of the chamber 88. Further, in accord with the illustrated embodiment thereof, the chamber 88 on the inner surface is suitably provided with scoop means. The latter means is operative to effect a scooping up, i.e., lifting, of the hot sand as the latter traverses the length of the chamber 88. After being lifted up by the scoop means, the hot sand cascades over the outer surface of the wall that serves to define the chamber 30. As a consequence, the outer wall surface of the chamber 30 is heated by the hot sand cascading thereover. The effect thereof is a heat exchange between the hot sand traversing the interior of the chamber 88 and the outer wall of the chamber 30 such that the hot sand heats up the outer wall of the chamber 30 while the latter being cooler functions to effect a cooling of the hot sand that comes into contact therewith as the hot sand traverses the length of the chamber 88.

From the chamber 88, the used foundry sand passes into a sifting chamber 94. The latter chamber 94 is suitably located so as to be in juxtaposed relation to the right end, as viewed with reference to FIG. 2 of the drawing, of the chamber 88. The sifting chamber 94 is substantially cylindrical in configuration and is provided on its outer surface with a suitably dimensioned opening. Positioned in juxtaposed relation to this opening is a suitably dimensioned screen 96. In addition, the sifting chamber 94 has a slot 98 provided in one of the end walls thereof. While in the sifting chamber 94, the used foundry sand undergoes a sifting action. That is, as the sifting chamber 94 rotates in the same fashion as the chamber 88, the used foundry sand is sifted whereby those sand particles which are of the desired size pass through the screen 96 and enter the collecting chamber 100, which is located beneath the screen 96. On the other hand, any oversized material that may be present in the used foundry sand such as pieces of metal, ceramic, etc., is discharged from the sifting chamber 94 through the slot 98.

After passing through the screen 96, the sand particles enter the collecting chamber 100 and are discharged from the latter into a collecting chute, the latter being denoted by the reference numeral 102 in FIG. 2. The collecting chute 102 is designed, as best seen with reference to FIG. 1, to be operatively connected to the cooling pipe means 20 such that sand particles leaving the collecting chamber 100 of the heat exchanger means 14 are conveyed through the collecting chute 102 to the cooling pipe means 20 wherein the sand particles, in a manner yet to be described, are subjected to cooling.

More specifically, in accord with the illustration of FIG. 1, the collecting chute 102 is operatively connected to a surge hopper, the latter being depicted schematically at 104 in FIG. 1 of the drawing. Upon leaving the heat exchanger means 14, the sand particles are temporarily stored in the surge hopper 104 while awaiting to be fed to the cooling pipe means 20. Preferably, the surge hopper 104 is equipped with a metering gate, the latter being schematically depicted at 106 in FIG. 1.

The metering gate 106 which can take the form of any suitable conventional form of metering means, is designed to be operative to effect the discharge of sand particles from the surge hopper 104 to the cooling pipe means 20 such that sand particles are fed at a predetermined rate to the cooling pipe means 20.

With reference to FIG. 1 of the drawing, the cooling pipe means 20 will now be described. However, before proceeding with this description, it should be noted that the sand particles, upon leaving the heat exchanger means 14, are at a temperature approximating 400° F. Continuing, the cooling pipe means 20, as seen with reference to FIG. 1, embodies a cooling pipe 108. Regarding the dimensions of the cooling pipe 108, the diameter thereof is determined primarily based on the amount of used foundry sand that it is desired to have pass therethrough. Likewise, the length of the cooling pipe 108 is determined primarily based on the amount of cooling of the used foundry sand that it is desired to have take place as the used foundry sand travels the length of the cooling pipe 108. As depicted in FIG. 1, the cooling pipe 108 embodies a straight length, however, other configurations could equally well be used, if so desired, without departing from the essence of the present invention.

The cooling pipe 108 has one end thereof connected to an air blower 110, at a point upstream of the location whereat the used foundry sand enters the cooling pipe 108 from the surge hopper 104. Insofar as the air blower 110 is concerned, any type of air blower of conventional construction and appropriate for use in the manner set forth hereinafter may be so employed. The air blower 110 is operative for purposes of generating a sufficient air flow to effect the transport through the cooling pipe 108 of the grain sized used foundry sand particles at a preestablished velocity. The velocity at which the sand particles travel through the cooling pipe 108 is selected so as to be such that sand particles will be carried along in the air flow through the cooling pipe 108. That is, the velocity of the sand particles must be such as to cause the sand particles to travel to the end of the cooling pipe 108 and not drop out of the air stream intermediate the ends of the cooling pipe 108, whereupon a buildup of sand particles could occur in the cooling pipe 108 which would impede the cooling operation that it is intended to have take place within the cooling pipe 108.

The cooling pipe 108 can be fabricated from any suitable material capable of accommodating the temperature at which the used foundry sand is at when entering the cooling pipe 108, e.g., 400° F. For purposes of effecting the cooling of the used foundry sand in the cooling pipe 108, the latter is preferably encased within a water jacket 112. The water jacket 112 may be of a suitable conventional form of construction. In this regard, water is circulated to the water jacket 112 in a conventional fashion. To this end, as schematically depicted in FIG. 1 water enters the water jacket 112 through inlet means denoted by the reference numeral 114 in FIG. 1 and exits therefrom through the outlet means denoted by the reference numeral 116. It is to be understood that the inlet means 114 is operatively connected in fluid flow relation with a suitable source (not shown) of cooling fluid, e.g., cooling water.

In accord with the best mode embodiment of the invention, the cooling pipe 108 in addition is preferably provided at spaced intervals along the length thereof with a spinner means 118. The latter spinner means 118 each embody a substantially spiral interior surface which is operative to impart a spiral, i.e., spinning action, to the sand particles as they travel through each of the spinner means 118. The effect of imparting this spinning action at periodic intervals to the sand particles is to assist in ensuring that the sand particles maintain their requisite velocity as they travel the length of the cooling pipe 108. A suitable spacing between spinner means 108 has been found to be approximately ten feet. That is, the cooling pipe 108 preferably incorporates a spinner means 118 at each ten foot interval along the length thereof. In this regard as noted herein previously the length of the cooling pipe 108 is a function of the time that the sand particles must be retained in the cooling pipe 108 in order to effect the cooling thereof desired.

After traveling the length of the cooling pipe 108, the used foundry sand which has undergone cooling within the cooling pipe 108 is discharged therefrom and enters the cyclone/scrubber means 22. The latter cyclone/-scrubber means 22 is suitably provided with an opening (not shown) through which the used foundry sand enters. Moreover, as best understood with reference to FIG. 1 of the drawing, the cyclone/scrubber means 22 comprises a cyclone unit 120 which embodies a ceramic scrubber sleeve 122. The ceramic scrubber sleeve 122 which preferably possesses a slightly roughened surface is suitably located within the cyclone unit 120 so as to be in the path of movement of the sand particles after the latter enter the cyclone unit 120. The function of the scrubber sleeve 122 is to effect a cleansing of the sand particles through the engagement thereof with the slightly roughened surface of scrubber sleeve 122. After engaging the scrubber sleeve 122, the sand particles move in a circular path within the cyclone unit 120 until eventually they make their way to the bottom of the latter. That is, the used foundry sand travels to the bottom of cyclone unit 120 along the outward wall thereof because of the rotational movement of the material within the cyclone unit 120, and gradually travels toward the area of the center discharge pipe, which is identified in the drawing by reference numeral 124. The used foundry sand is discharged from the cyclone unit 120 through the discharge pipe 124 and thus from the system 10 as cooled and reclaimed used foundry sand. The discharge pipe 124 may be operatively connected to any suitable form of secondary cooling means (not shown) for receiving the cooled and reclaimed used foundry sand from the system 10. In addition, the cyclone/scrubber means 22 is preferably also provided with a further discharge pipe, identified schematically at 126 in FIG. 1 through which dust present in the cyclone unit 120 is discharged therefrom and is conveyed to a suitable means (not shown) such as a conventional baghouse wherein treatment of the dust can take place.

To complete the description of the system 10 constructed in accordance with the present invention, note is taken here of the fact that as the used foundry sand is made to pass therethrough, fumes and dust are generated. Thus, for purposes of evacuating the fumes and dust that are generated, for instance, in the heat exchanger means 14, one approach that may be taken involves the injection of gas thereinto through the pipe, identified generally by the reference numeral 128 in FIG. 2 of the drawing. In accord with the illustration of FIG. 2, this gas then flows into the venturi shaped nozzle, denoted by the reference numeral 130 in FIG. 2. The effect of this flow of gas to the nozzle 130 is to create an area of reduced pressure within the heat exchanger means 14. Moreover, the burning of the gas heats up the air within the heat exchanger means 14 and causes the fumes to oxidize. For purposes of assisting the latter process, a catalytic converter seen at 132 in FIG. 2 may be emplaced within the heat exchanger means 14. After passing through the catalytic converter 132 in accord with the showing of FIG. 2, the gases pass through a pipe 134 which traverses the interior of the chamber 30. The heat being radiated from the pipe 134 assists in effecting a preheating of the used foundry sand.

In accord with another approach, the fumes and dust are made to exit from the heat exchanger means 14 through the pipe means, identified schematically at 136 in FIG. 1. More specifically, as best seen with reference to FIG. 1, the pipe means 136 is operatively connected in fluid flow relation with the cyclone/scrubber means 18. As such the fumes and dust from the heat exchanger means 14 are conveyed through pipe means 136 to the cyclone/scrubber means 18. Moreover, in accord with the illustration of the embodiment of the system 10 depicted in FIG. 1, a catalytic converter, schematically identified by the reference numeral 138 is connected in operative relation with the pipe means 136 intermediate the heat exchanger means 14 and the cyclone/scrubber means 18. Also, located along the length of the pipe means 136 there is preferably emplaced an airjector means 140.

In the cyclone/scrubber means 18 the fumes from the heat exchanger means 14 burn up due to the high temperature that exists within the cyclone/scrubber means 18. The hot gas generated as a consequence of this burning up of the fumes and the dust from the heat exchanger means 14 are made to exit from the cyclone/-scrubber means 18 through the pipe means, schematically shown at 142 in FIG. 1, and are conveyed by the latter to a recuperator 144 to which the pipe means 142 is operatively connected. The recuperator 144 may embody any suitable conventional form of construction. The now cooled gas and dust are made to exit from the recuperator 144 through pipe means 146, the latter being operatively connected to means (not shown) such as a conventional baghouse wherein the dust is suitably treated. Finally, preferably at a point intermediate the cyclone/scrubber means 18 and the recuperator 144, pipe means 148 are operatively connected to the pipe means 142 such that hot air at a temperature approximating 1500° F. is made to flow from the pipe means 142 to the catalytic converter 138 wherein the hot air is injected into the latter in an effort to ensure that a temperature sufficient for the proper operation of the catalytic converter 138 is reached therewithin.

With further reference to the matter of the burning up of the fumes from the heat exchanger means 14 in the cyclone/scrubber means 18 the aforereferenced airjector 140 is employed for purposes of making available additional oxygen such as to ensure that sufficient oxygen is present within the cyclone/scrubber means 18 to accomplish the desired burning up of fumes. Further in this connection, as best understood with reference to FIG. 1, a suitable fluidizing medium is made to flow to the cyclone/scrubber means 18. More specifically, as depicted in FIG. 1 by the reference numeral 150 the recuperator 144 has a suitable amount of compressed air supplied thereto from a suitable source (not shown) thereof. Moreover, through suitable pipe means, seen schematically at 152 in FIG. 1, air is made to flow from the recuperator 144 to the lower portion of the cyclone/scrubber means 18 whereupon the air enters the latter and is operative therewithin to impart a fluidizing action to the used foundry sand which is present in the cyclone/scrubber means 18.

A brief summary will now be had of the mode of operation of the system 10 constructed in accordance with the present invention. Used foundry sand to be reclaimed is fed from storage hopper 24 to the heat exchanger means 14. While in the course of passing through the latter in a first direction the used foundry sand is preheated from ambient temperature to a temperature approximating 750° F. Moreover, oversized material and metal present in the used foundry sand is removed therefrom and friable sand lumps are made to disintegrate in the course of the first pass of the used foundry sand through the heat exchanger means 14. From the heat exchanger means 14 the used foundry sand is fed to the thermal pipe reclaimer means 16. It is in the latter that the used foundry sand is subjected to thermal reclamation. Namely, the organic matter present in the used foundry sand is burned away. Upon exiting from the thermal pipe reclaimer means 16 the used foundry sand passes into the cyclone/scrubber means 18 wherein the sand particles undergo scrubbing and post reclamation of the used foundry sand takes place. Then, the used foundry sand is fed once again to the heat exchanger means 14 wherein during a second pass through the latter the used foundry sand undergoes cooling. Lastly, the used foundry sand is conveyed from the heat exchanger means 14 to the cooling pipe means 20 wherein further cooling of the used foundry sand is had. Exiting from the cooling pipe means 20 the used foundry sand goes to the cyclone/scrubber means 22 wherein a further scrubbing of the used foundry sand particles takes place followed by the discharge of the reclaimed used foundry sand from the system 10.

Thus, in accordance with the present invention there has been provided a new and improved system for treating solid, granular and aggregate material which embodies therein reclaimer means for effecting the thermal removal of matter from the material as well as the removal therefrom of metal and lumps. Moreover, a new and improved thermal reclaimer apparatus is provided which is capable of being cooperatively associated in operative relation with the other components that together therewith comprise the system of the present invention for treating solid, granular and aggregate material. In addition, in accord with the present invention such a thermal reclaimer apparatus for such a system for treating solid, granular and aggregate material is provided that is characterized in that it is relatively inexpensive to manufacture. Further, the subject thermal reclaimer apparatus for such a system of the present invention for treating solid, granular and aggregate material is characterized in that it is capable of being easily installed and at low cost. Additionally, in accordance with the present invention such a thermal reclaimer apparatus for such a system for treating solid, granular and aggregate material is provided that is characterized in that it necessitates little attention being given thereto during the operation thereof. Penultimately, the subject thermal reclaimer apparatus for such a system of the present invention for treating solid, granular and aggregate material is characterized in that it requires little maintenance. Lastly, in accordance with the present invention such a thermal reclaimer apparatus for such a system for treating solid, granular and aggregate material is provided that is characterized in that it is highly efficient from the standpoint of the amount of energy required to be used thereby for purposes of the operation thereof.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all other modifications, which fall within the true spirit and scope of my invention.

What is claimed is:

1. A system for treating solid, granular and aggregate material thermally comprising:

(a) storage hopper means containing a supply of the material to be thermally treated;

(b) heat exchanger means including a first chamber means, a second chamber means and rotating means cooperatively associated with said first chamber means and said second chamber means for effecting the rotation thereof, said first chamber means having inlet means connected to said storage hopper means for receiving material therefrom and outlet means, said first chamber means being operative to retain the material therewithin while the material is being preheated during the course of the passage thereof in a first direction through said first chamber means, said second chamber means having reentry means and discharge means, said discharge means being operative to discharge material from said second chamber means, said second chamber means being operative to retain the material therewithin while the material undergoes cooling during the course of the passage thereof in a second direction through said second chamber means, said second chamber means being located in juxtaposed relation to said first chamber means such that the preheating of the material during the passage thereof through said first chamber means and the cooling of the material during the passage thereof through said second chamber means is effected by a heat exchange between the material traversing said second chamber means in a second direction and the material traversing said first chamber means in a first direction; and (c) thermal pipe means for thermally treating the material, said thermal pipe means having one end thereof connected to said outlet means of said first chamber means of said heat exchanger means for receiving material therefrom, said thermal pipe means including blower means and burner means operative to generate a hot gas flow through said thermal pipe means for subjecting the material to a predetermined temperature for a preestablished period of time in order to effect the thermal treatment thereof.

2. The system for treating solid, granular and aggregate material as set forth in claim 1 wherein said heat exchanger means further includes means operative for effecting the separation of metal from the material before the material enters said thermal pipe means.

3. The system for treating solid, granular and aggregate material as set forth in claim 1 wherein said heat exchanger means further includes means operative for effecting the disintegration of friable lumps present in the material before the mateial enters said thermal pipe means.

4. The system for treating solid, granular and aggregate material as set forth in claim 1 further including cyclong/scrubber means having an inlet means connected to the other end of said thermal pipe means for receiving material therefrom and outlet means connected to said reentry means of said second chamber means of said heat exchanger means for supplying material thereto, said cyclone/scrubber means being operative to effect a scrubbing of the particules of material passing therethrough.

5. The system for treating solid, granular and aggregate material as set forth in claim 4 wherein said cyclone/scrubber means further includes means for retaining the material in said cyclone/scrubber means while the material undergoes post reclamation.

6. The system for treating solid, granular and aggregate material as set forth in claim 4 further including means for conveying fumes and dust from said heat exchanger means to said cyclone/scrubber means, the fumes being burned up in said cyclone/scrubber means due to the high temperature present therewithin.

7. The system for treating solid, granular and aggregate material as set forth in claim 6 further including means operatively connected to said cyclone/scrubber means for providing additional oxygen to said cyclone/scrubber means to be used in connection with the burning up of fumes therewithin.

8. The system for treating solid, granular and aggregate material as set forth in claim 6 further including means operatively connected to said cyclone/scrubber means for providing a fluidizing medium thereto, the fluidizing medium being operative to impart a fluidizing action to the material present in said cyclone/scrubber.

9. The system for treating solid, granular and aggregate material as set forth in claim 4 further including catalytic converter means connected in interposed relation to said heat exchanger means and said cyclone/-scrubber means.

10. The system for treating solid, granular and aggregate material as set forth in claim 9 further including means connected to said catalytic converter means and operative to effect a preheating of said catalytic converter means.

11. The system for treating solid, granular and aggregate material as set forth in claim 4 further including cooling pipe means having one end thereof connected to said discharge means of said second chamber means of said heat exchanger means for receiving material therefrom, said cooling pipe means including blower means for generating an air flow through said cooling pipe means for subjecting the material to cooling for a preestablished period of time in said cooling pipe means.

12. The system for treating solid, granular and aggregate material as set forth in claim 11 further including a second cyclone/scrubber means having an inlet means connected to the other end of said cooling pipe means for receiving material therefrom and outlet means for discharging material from said second cyclone/scrubber means, said second cyclone/scrubber means being operative to effect a scrubbing of the particles of material passing therethrough.

* * * * *